US008443470B2

(12) United States Patent
Webb

(10) Patent No.: US 8,443,470 B2
(45) Date of Patent: May 21, 2013

(54) BATHTUB SAFETY GATE

(76) Inventor: Moses Webb, Gilbert, AZ (US)

( * ) Notice: Subject to any disclaimer, the term of this patent is extended or adjusted under 35 U.S.C. 154(b) by 41 days.

(21) Appl. No.: 13/218,387

(22) Filed: Aug. 25, 2011

(65) Prior Publication Data

US 2012/0096638 A1 Apr. 26, 2012

Related U.S. Application Data

(60) Provisional application No. 61/406,449, filed on Oct. 25, 2010.

(51) Int. Cl.
*A47K 3/00* (2006.01)

(52) U.S. Cl.
USPC ..... 4/559

(58) Field of Classification Search
USPC ..... 4/538–595
See application file for complete search history.

(56) References Cited

U.S. PATENT DOCUMENTS

| | | | | |
|---|---|---|---|---|
| 4,884,614 | A | 12/1989 | Spurling | |
| 5,249,315 | A | 10/1993 | Moylan | |
| 5,570,543 | A | 11/1996 | Bishop | |
| 5,771,505 | A * | 6/1998 | Reynolds | 4/559 |
| 2009/0044450 | A1 * | 2/2009 | Hallman | 49/50 |

* cited by examiner

*Primary Examiner* — Lori Baker
(74) *Attorney, Agent, or Firm* — Richard C. Litman

(57) ABSTRACT

The bathtub safety gate is a two-piece door fabricated from molded plastic and positioned to cover the front or entry of the bathtub. The door parts are mounted for hinged or swinging movement on the end walls of the tub. Overlapping members are provided at the mating ends of the doors to permit a degree of adjustability. Pins or other fastening devices are contemplated for locking the doors in closed position when not in use.

10 Claims, 4 Drawing Sheets

BATHTUB SAFETY GATE

CROSS-REFERENCE TO RELATED APPLICATION

This application claims the benefit of U.S. Provisional Patent Application Ser. No. 61/406,449, filed Oct. 25, 2010.

BACKGROUND OF THE INVENTION

1. Field of the Invention

The present invention generally relates to safety accessories, and particularly to a bathtub safety gate that prevents unsupervised access to a bathtub by toddlers or infirm adults.

2. Description of the Related Art

The bathroom is the venue for many accidents in the home and a great many of these bathroom accidents involve the bathtub. Small children and infirm or Alzheimer-stricken adults often have unsupervised access to the bathtub, which access may result in injury or death due to scalding or drowning. The related art discloses barriers that are designed to prevent access to a bathtub by unattended persons such as children or handicapped adults. However, the disclosed related art has proven to be cumbersome and ineffective. The art would certainly welcome a bathtub barrier that would effectively prevent access to a bathtub by small children and some handicapped adults and yet be easily manipulated by able persons. Thus, a bathtub safety gate solving the aforementioned problems is desired.

SUMMARY OR THE INVENTION

The bathtub safety gate is a two-piece door fabricated from molded plastic and is positioned to cover the front or entry of the bathtub. The door parts are mounted for hinged or swinging movement on the end walls of the tub. Overlapping members are provided at the mating ends of the doors to permit a degree of adjustability. Pins or other fastening devices are contemplated for locking the doors in closed position when not in use.

Accordingly, the invention presents a bathtub safety gate that is strong and sturdy enough to prevent entry by a small child or infirm adult, yet lightweight enough to be easily manipulated by an able person. The invention provides for improved elements thereof in an arrangement for the purposes described that are inexpensive, dependable and fully effective in accomplishing their intended purposes. As presently contemplated, the invention will be made available in kit form.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
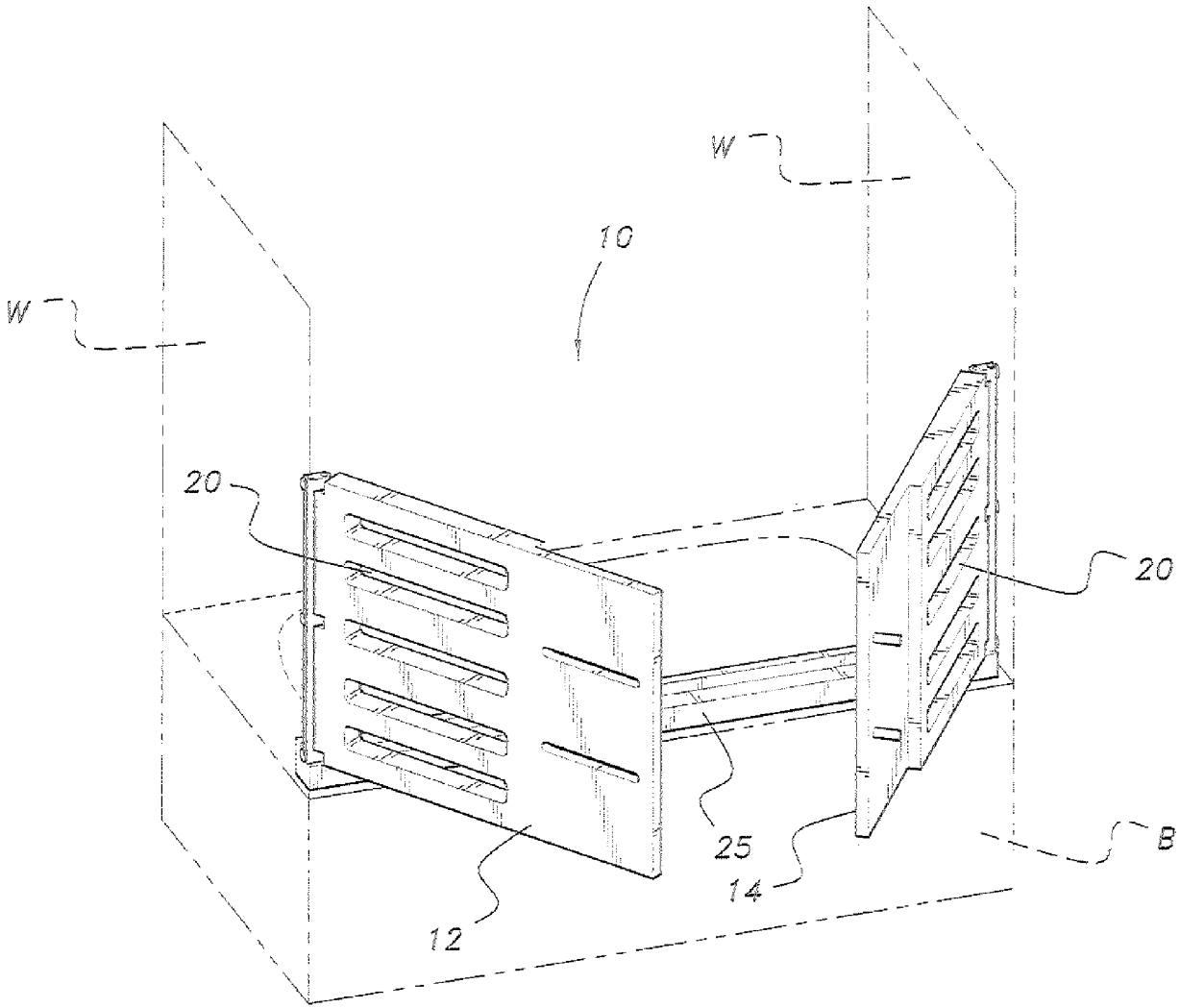
FIG. 1 is an environmental, perspective view of a bathtub safety gate according to the present invention, showing the gate in an open position.
Figure 2:
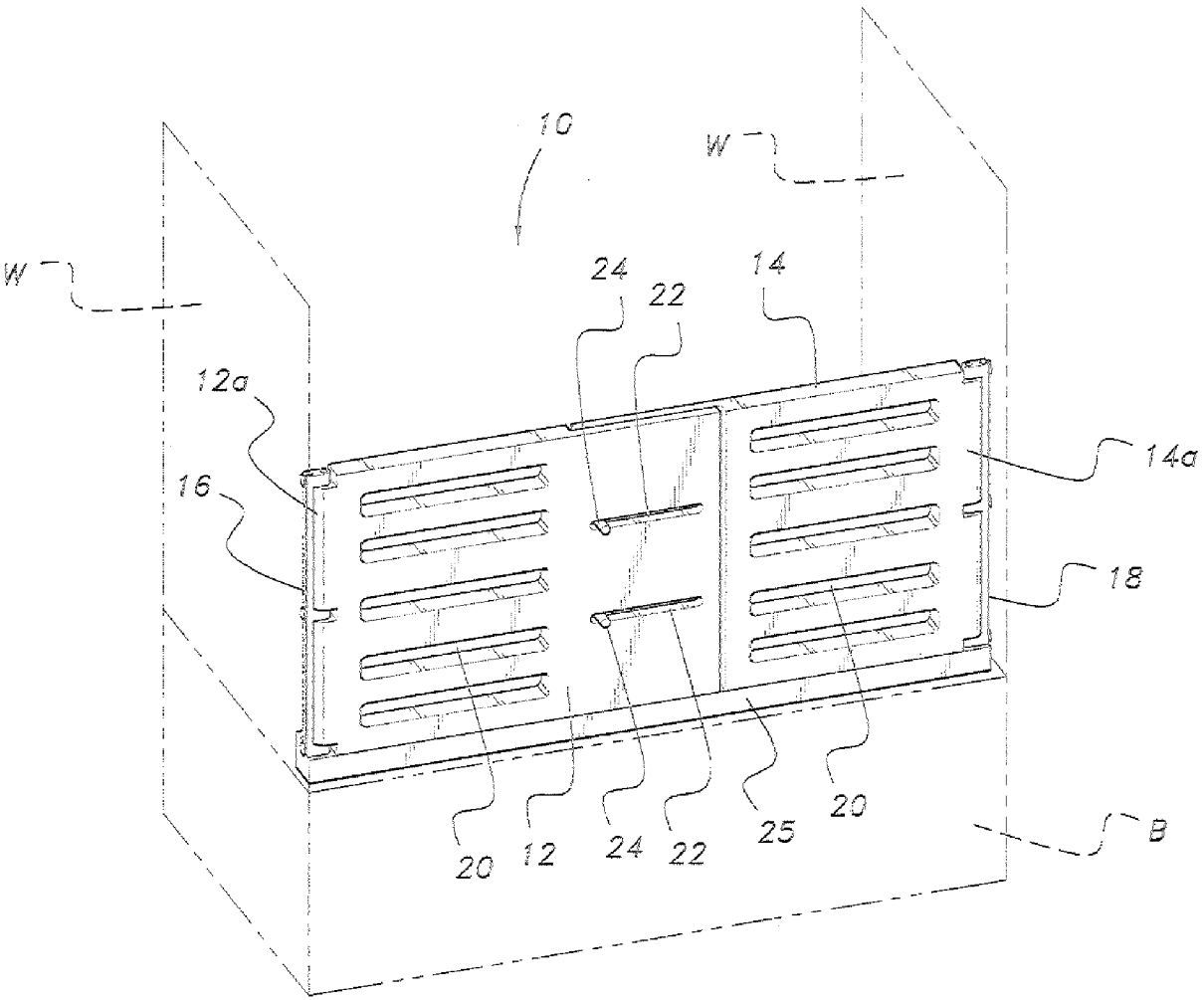
FIG. 2 is an environmental, perspective view of a bathtub safety gate according to the present invention, showing the gate in a closed position.
Figure 3:
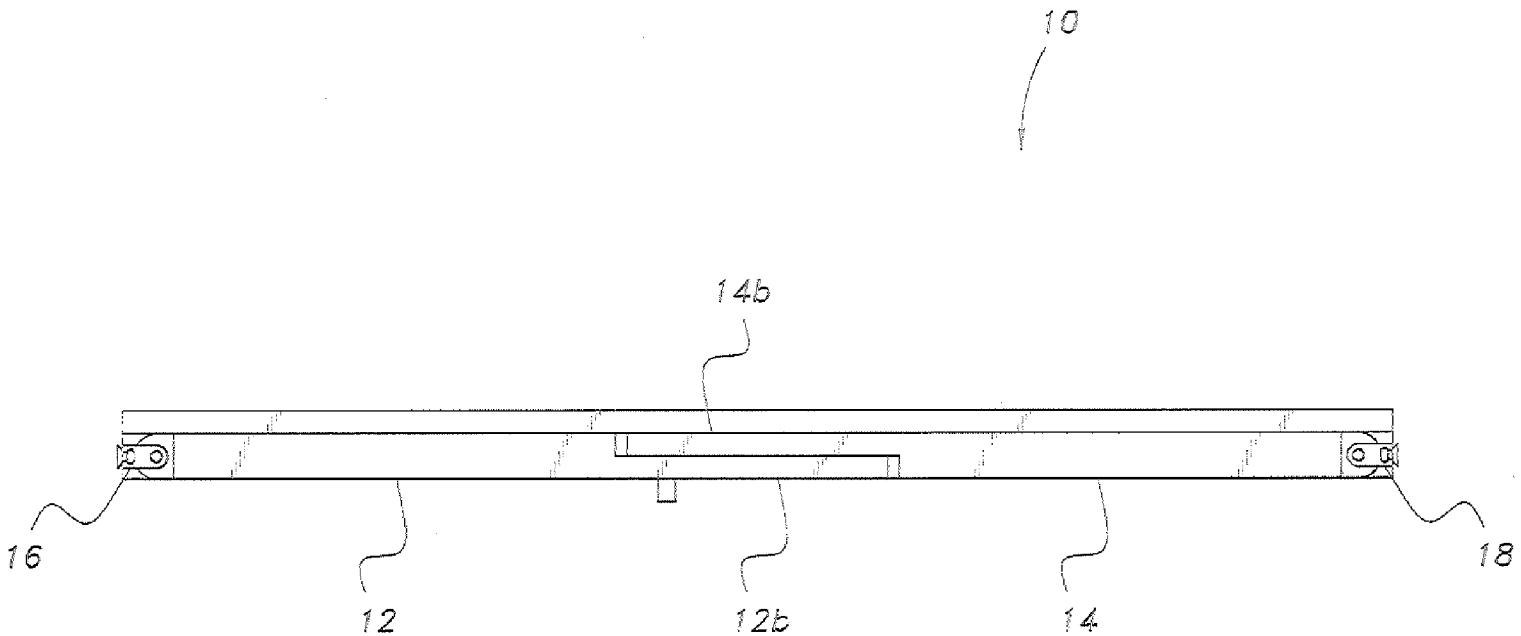
FIG. 3 is a top view of a bathtub safety gate according to the present invention, shown with the gate in a closed position.
Figure 4:
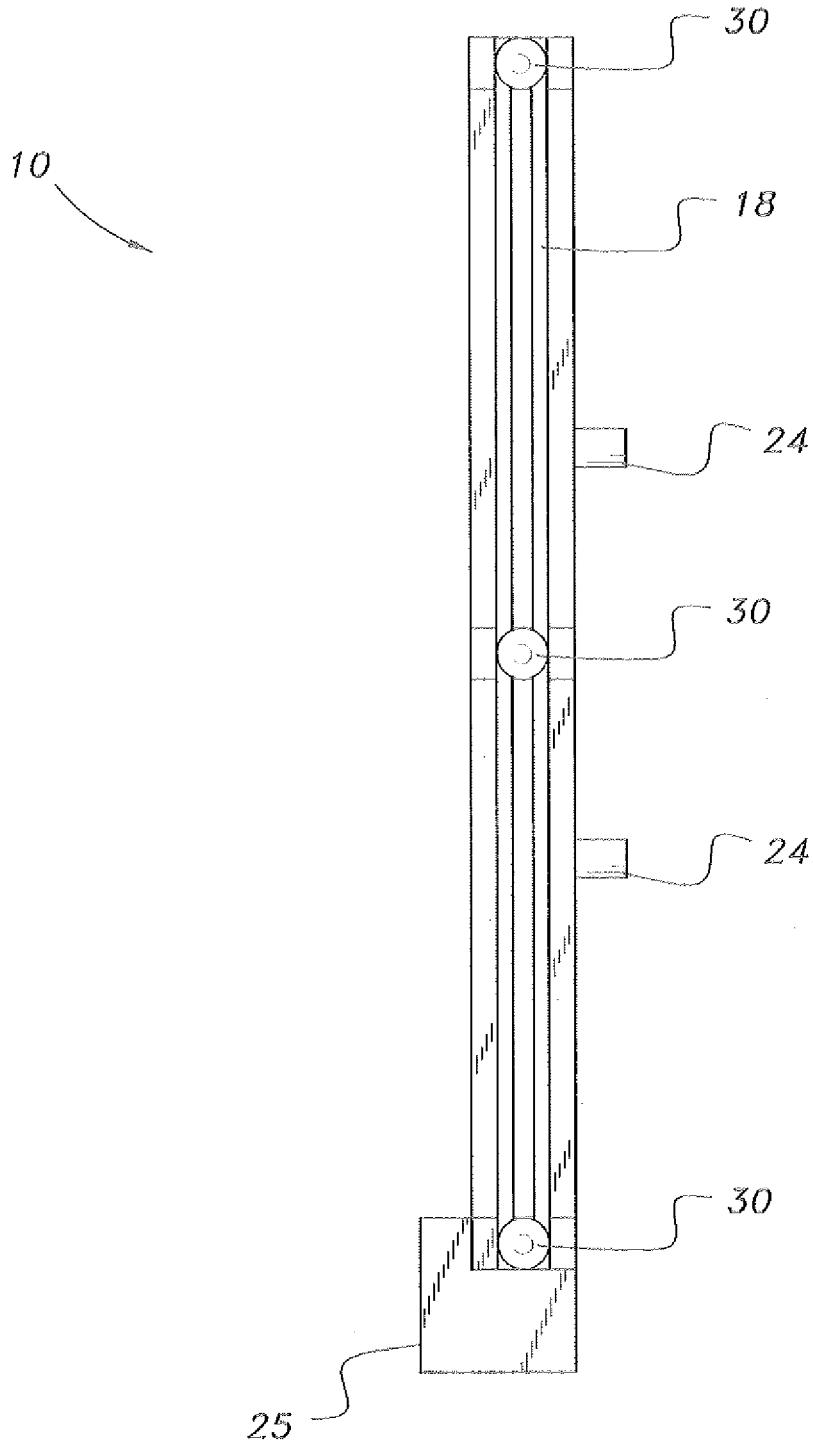
FIG. 4 is an end view of a bathtub safety gate according to the present invention, shown with the gate in a closed position.

Referring to FIGS. 1-4, the bathtub safety gate 10 comprises a pair of doors 12 and 14, each of the doors 12, 14 having respective distal ends 12*a* and 14*a* hinged to respective post members 16 and 18. Each door 12, 14 is of rectangular configuration and is approximately twenty-four inches high, twenty-five inches wide, and two inches thick. These dimensions may vary for different installation configurations. A plurality of rectangular openings 20 is provided in each door 12, 14 so that the tub enclosure can be visually inspected when the doors 12, 14 are closed. Although rectangular openings are preferred, it should be noted that openings of other configurations may be employed if desired.

Each door 12, 14 is fashioned with a respective overlap 12*b* and 14*b* to allow for size adjustment. One door 12 is provided with a pair of small slots 22 formed through the overlap portion 12*b*. The other door 14 is formed with pins 24 protruding from the face of the overlap portion 14*b*. When closed, the doors form a protective barrier having a length coextensive with the length of a bathtub B. The post members 16, 18 are removably attached at their respective lower ends to an elongate base member 25, which is adapted to rest on the edge of the bathtub B. Each post member 16, 18 is respectively positioned adjacent opposed tub walls W. Each post member is provided with a plurality of suction cups 30, whereby the post members 16, 18 can be attached to end tub walls W. When closed, the inside faces at the lower edges of the doors will abut base member 25.

Assembly is simple. (1) The base member 25, doors 12, 14, and post members 16, 18 are positioned on the edge of the bathtub B. (2) Each post member 16, 18 is secured to the tub walls by pushing the suction cups 30 toward the respective wall. (3) The overlapping members 12*b*, 14*b* are secured in place via the slots 22 and pins 24 arrangement.

It is to be understood that the present invention is not limited to the embodiment described above, but encompasses any and all embodiments within the scope of the following claims.

I claim:

1. A bathtub safety gate, comprising:

a first door assembly having a first post and a first door pivotally attached to the post, the first door having a distal end and a proximate end;

a second door assembly having a second post and a second door pivotally attached to the post, the second door having a distal end and a proximate end, the proximate end of the first door overlapping the proximate end of the second door, wherein the proximate end of the first door has a plurality of small slots defined therethrough and the proximate end of the second door is provided with an array of small pins thereon, the pins mating with the slots to releasably fasten said doors together;

a first plurality of suction cups mounted to the first post; and a second plurality of suction cups mounted to the second door.

2. The bathtub safety gate according to claim 1, wherein said first door and said second door are fabricated from plastic material.

3. The bathtub safety gate according to claim 1, wherein a plurality of inspection openings is respectively formed through said first door and through said second door.

4. The bathtub safety gate according to claim 1, further comprising a plurality of hinges pivotally attaching the first and second doors to the distal ends of said first door and said second door, respectively.

5. A bathtub safety gate, comprising:

a first door assembly having a first post and a first door pivotally attached to the post, the first door having a distal end and a proximate end, the first door being fabricated from molded plastic material;

a second door assembly having a second post and a second door pivotally attached to the post, the second door having a distal end and a proximate end, the proximate end of the first door overlapping the proximate end of the second door, the second door being fabricated from molded plastic material, the proximate end of the first door overlapping the proximate end of the second door, the first door and the second door defining a barrier having a length and a lower edge, the first and second doors having a plurality of inspection openings defined therethrough, wherein the proximate end of the first door has a plurality of small slots formed therethrough, and the proximate end of the second door further comprising a plurality of small pins thereon mating with the slots to releasable fasten the doors closed;

a first plurality of suction cups mounted to the first post; and a second plurality of suction cups mounted to the second post.

6. The bathtub safety gate according to claim 5, further comprising a plurality of hinges pivotally attaching the first and second doors to the distal ends of said first door and said second door, respectively.

7. The bathtub safety gate according to claim 5, wherein each said post has a lower end, the gate further including a base member having a length coextensive with the length of said barrier, the lower end of each said post being removably attached to the base member.

8. A kit for forming a protective barrier having a length to cover an entry to a bathtub, the kit comprising;

a first door having a distal end and a proximate end;

a second door having a distal end and a proximate end, wherein the proximate end of the first door has a plurality of small slots formed therethrough, and the proximate end of the second door further comprising a plurality of small pins thereon mating with the slots to releasably fasten the doors closed;

respective post members pivotally to the distal ends of the first door and the second door; and a base member having a length coextensive with the length of the barrier, the posts being removably attachable to the base member.

9. The kit according to claim 8, wherein said first door and said second door are fabricated from molded plastic material.

10. The kit according to claim 9, further including suction cups mounted on said respective post members.

* * * * *